US006182043B1

(12) United States Patent
Böldl

(10) Patent No.: US 6,182,043 B1
(45) **Date of Patent: *Jan. 30, 2001**

(54) DICTATION SYSTEM WHICH COMPRESSES A SPEECH SIGNAL USING A USER-SELECTABLE COMPRESSION RATE

(75) Inventor: Herbert Böldl, Vienna (AT)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/795,826

(22) Filed: Feb. 6, 1997

(30) Foreign Application Priority Data

Feb. 12, 1996 (AT) ..... 96200328

(51) Int. Cl.[7] ..... G10L 9/00
(52) U.S. Cl. ..... 704/270; 369/25
(58) Field of Search ..... 704/270, 272, 704/235; 379/88, 89, 25

(56) References Cited

U.S. PATENT DOCUMENTS 5,086,475 * 2/1992 Kutaragi et al. ..... 704/201
5,347,478 * 9/1994 Suzuki et al. ..... 704/211
5,812,882 * 9/1998 Raji et al. ..... 710/72
5,839,100 * 11/1998 Wegner ..... 704/220
5,884,269 * 3/1999 Cellier et al. ..... 704/501

* cited by examiner

*Primary Examiner*—Emanuel Todd Voeltz
*Assistant Examiner*—M. David Sofocleous
(74) *Attorney, Agent, or Firm*—David R. Treacy

(57) ABSTRACT

A dictation system is disclosed comprising a hand held dictation device (1) for storing a speech signal in memory means (15,20), the device comprising data compression means (30) for data compressing the speech signal into a data compressed speech signal and storing means for storing the data compressed speech signal in the memory means. The data compression means (30) are adapted to carry out a data compression step on the speech signal in one of at least two different data compression modes, the at least two different data compression modes resulting in different data compression ratios when applied to the same speech signal, the said at least two different data compression modes being selectable by a user. The data compression means (30) are further adapted to create data files ($B_i$) comprising portions of the data compressed speech signal, each of the data files comprising a header portion (HDR), the data compression means being also adapted to generate an identifier signal identifying the data compression mode selected and being adapted to store said identifier signal in said header portion.

24 Claims, 3 Drawing Sheets

DICTATION SYSTEM WHICH COMPRESSES A SPEECH SIGNAL USING A USER-SELECTABLE COMPRESSION RATE

The invention relates to a dictation system, comprising a hand held dictation device for storing a speech signal in memory means, the device comprising data compression means for data compressing the speech signal into a data compressed speech signal, storing means for storing the data compressed speech signal in the memory means, to a hand held dictation device, a transcription device and to a removable solid state memory unit for use in the dictation system. A dictation system as defined in the opening paragraph is well known in the art.

DESCRIPTION OF THE RELATED ART

Data compression may be realized in prior art dictation systems by discarding the silence periods normally present in the speech signal. Further, one may store an indication signal indicating the length of the silence period and its location in the speech signal. Upon transcription, a replica of the speech signal can be regenerated by inserting silence periods of the same length at the indicated positions in the compressed speech signal.

SUMMARY OF THE INVENTION

The invention aims at providing an improved dictation system. The dictation system in accordance with the invention is characterized in that the data compression means are adapted to carry out a data compression step on the speech signal in one of at least two different data compression modes, the at least two different data compression modes resulting in different data compression ratios when applied to the same speech signal, the said at least two different data compression modes being selectable by a user, the data compression mean; being further adapted to create data files comprising portions of the data compressed speech signal, each of the data files comprising a header portion, the data compression means being also adapted to generate an identifier signal identifying the data compression mode selected and being adapted to store said identifier signal in said header portion. The invention is based on the following recognition. The memory capacity of memories included in dictation apparatuses is limited. Preferably, an increased number of dictations should be stored in a memory. This has been realized in the prior art by leaving out the silence periods present in a speech signal. A larger compression ratio can be obtained by applying more powerful compression techniques. More specifically, lossy compression techniques result in large data compression ratios. Larger data reduction ratios, however, may lead to a decrease in quality of the retrieved signal upon data expansion. In accordance with the invention, a dictation system has been proposed in which the user has the possibility to choose one data compression mode from two or more data compression modes in which the hand held dictation device can compress the speech signal. The user can make a trade off between the number of speech messages that he wants to dictate and store in one memory unit and the quality of the speech signal upon reproduction. If the user wants to have more dictations stored in the memory, he will select the data compression mode giving a higher data compression ratio. If the user prefers a higher quality of reproduction, he win choose the data compression mode giving a lower data compression ratio.

The subclaims define preferred embodiments of the dictation system, the hand held dictation device, a transcription device and the removable solid state memory unit.

BRIEF DESCRIPTION OF THE DRAWINGS

These and other aspects of the invention will be apparent from and elucidated further with reference to the embodiments described in the following figure description, in which.

DETAILED DESCRIPTION OF THE INVENTION

Figure 1:
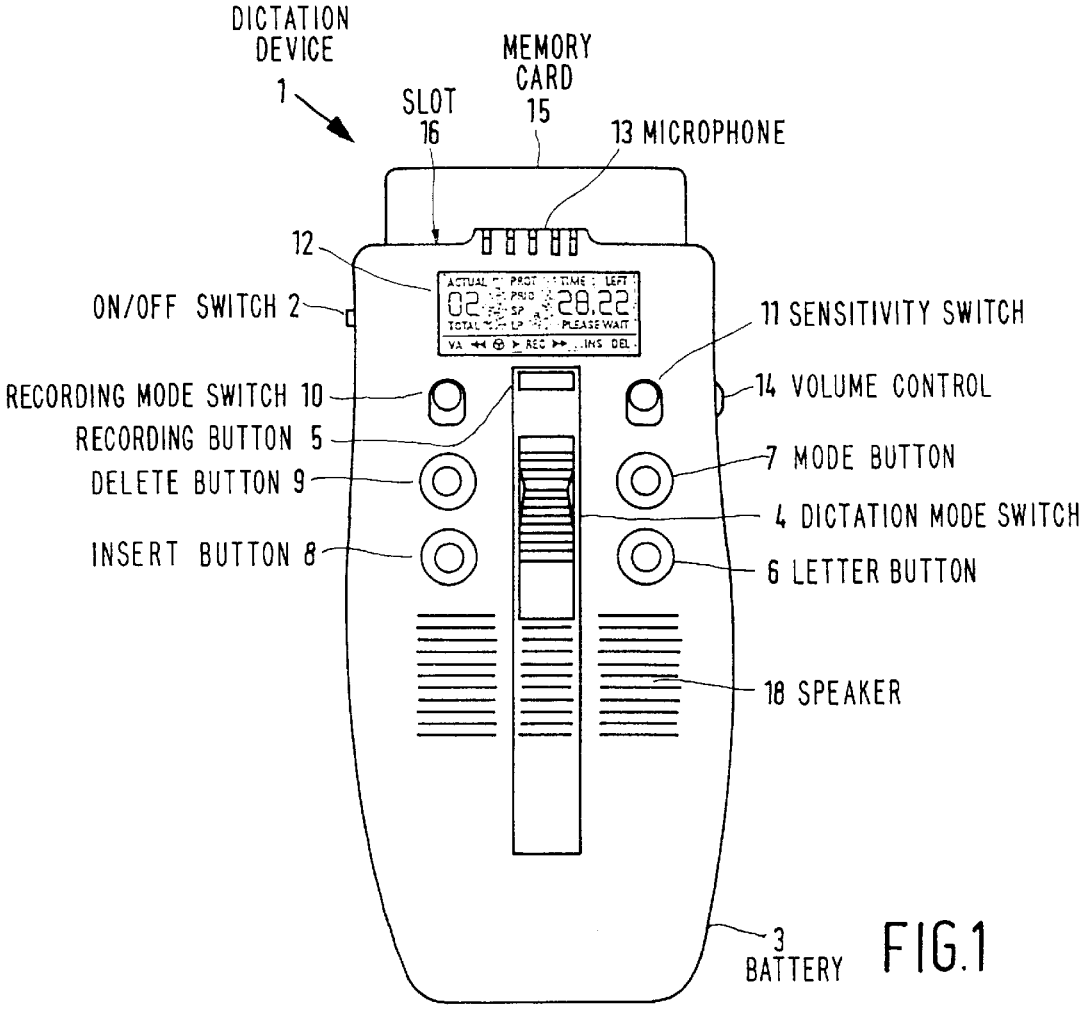
FIG. 1 shows an embodiment of the hand held dictation device.

FIG. 1 shows a front view of a handheld dictation device 1 provided with an on/off switch 2 located on the side of the housing of the device. At the bottom of the housing a battery compartment 3 (not shown) is provided that can be reached at the back of the housing. A sliding switch 4 is provided on the front face of the housing for switching the device in the various dictation modes. The device is provided with a number of buttons: button 5 is the record button, button 6 is the LETTER button, button 7 is the MODE button, button 8 is the INSERT button and button 9 is the DELETE button. The switch 10 is the recording mode switch. The switch 11 is the sensitivity switch. The device 1 is further provided with a LCD display for displaying various information regarding a dictation, such as the recording time of the dictation, the recording time left, the recording mode, the number of dictations, etc.

A microphone 13 and a loudspeaker 18 are provided in the housing and a volume control knob 14 is provided on the side of the housing. Further, a slot 16 is provided in the top face of the device for receiving a memory card 15.

Figure 2:
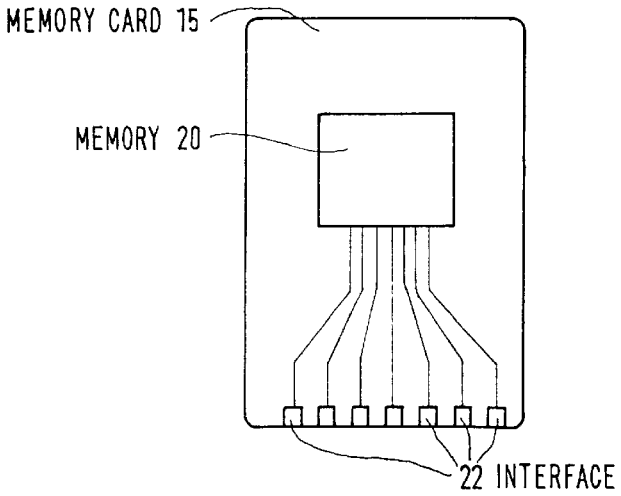
FIG. 2 shows an embodiment of the memory card for use in the hand held dictation device.

The memory card 15 is also shown in FIG. 2. The memory card 15 is provided with a solid state memory 20 and with electrical terminals 22 connected to the solid state memory 20. The solid state memory 20 can eg. be an EEPROM or a flash erasable memory. The electrical terminals 22 can be such that they enable an electrical cooperation with the internationally standardized PCMCIA interface of a PC.

Figure 3:
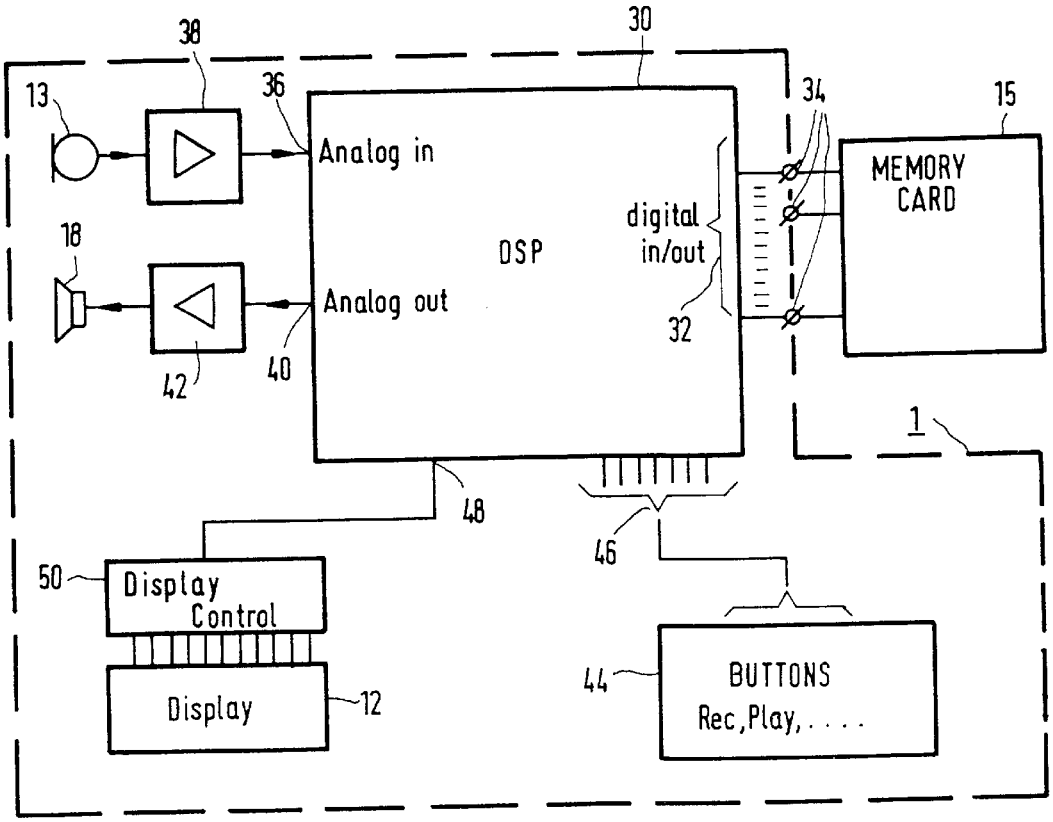
FIG. 3 shows the circuit diagram in the hand held dictation device.

FIG. 3 shows the electrical construction of the device 1 and its cooperation with the memory card 15. The device 1 comprises a digital signal processor 30, having a digital input/output 32 coupled to terminals 34 that are electrically coupled to the terminals 22 of the memory card 15, when positioned in the slot 16. The microphone 13 is coupled to an analog input 36 of the processor 30, if required via an amplifier 38. The processor 30 further comprises an analog output 40 which is coupled to the loudspeaker 18 via an amplifier 42. The various knobs and buttons, denoted in FIG. 3 by the reference numeral 44 are coupled to control inputs 46 of the processor 30. Further, a control output 48 of the processor 30 is coupled to a display control unit 50 for controlling the display of information on the display 12.

The user places the memory card 15 into the slot 16 of the device 1 until the terminals 22 of the memory card 15 come into contact with electrical terminals 34 provided in the slot of the device 1. The memory card is now in electrical and mechanical contact with the device 1.

The processor 30 is capable of receiving the analog speech signals via the input 36 and to A/D convert the speech signal into a digital speech signal. Further, upon selection by the user, the processor 30 is capable of carrying out one of at least two different data compression steps on the digital speech signal. Suppose, the processor 30 is capable of carrying out two data compression steps on the speech signal. Each compression step carried out on the same speech signal results in different compression ratios. The data compression steps can be in the form of lossless compression steps. This means that no data is actually lost and the original speech signal can be fully recovered upon data expansion. One example of a lossless data compression method is linear predictive coding followed by a Huffman encoding carried out on the output signal of the linear predictive coder. Data compression can also be lossy. One such lossy data compression step is subband coding, well known in the art and applied in DCC digital magnetic recording systems. In lossy compression methods, part of the information that is unaudible is actually thrown away. Upon data expansion, a replica of the original speech signal is recovered. As the information that is left out upon data compression was unaudible, the replica of the speech signal will be heard by the user as being the same as the original speech signal.

The processor 30 may be capable of carrying out a lossless data compression step on the speech signal and a lossy data compression step, as the two different data compression steps that can be realized by the processor 30. As an alternative, the processor 30 can carry out two different lossless data compression steps resulting in different data compression ratios. As again another alternative, the processor 30 may be capable of carrying out two different lossy data compression steps on the speech signal, resulting in two different data compression ratios. As an example of the last possibility: the processor 30 could be provided with a simple subband encoder as applied in DCC. The subband encoder can be simple as less subbands are required for encoding the speech signal. Less subbands are required, eg. 5 instead of the 32 in the DCC subband encoder, as the bandwidth of the speech signal is much smaller than a wideband audio signal. Different compression ratios can be obtained with the simplified subband encoder by changing the bitpool for the bitallocation step in the simplified subband encoder. Reference is made in this respect to the documents (1), (2), (3a) and (3b) in the list of documents that can be found at the end of this description.

When the user wants to record a speech message into the device, he depresses the LETTER button 6, which indicates that the user wants to store a speech message. Further, the user can actuate the MODE button 7 in order to select various modes, such as whether the speech message should have a (high) priority, or whether the speech message should be protected from overwriting. Subsequently the user selects a recording mode by actuating the button 10. Selecting the recording mode means that the user selects a data compression mode. If the user wants a relatively good quality recording, he/she chooses the data compression mode resulting in the lowest data compression ratio. As a result, a larger amount of information will be stored in the memory 20 for the said dictation, so that less dictations can be stored in said memory. If the user wants as many dictations as possible being stored in the memory 20, he/she will choose the data compression mode resulting in the higher data compression ratio. A lower quality storage of the dictations may be the result.

Figure 4:
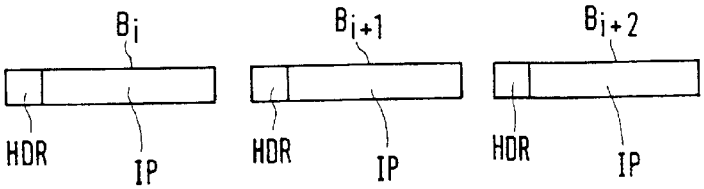
FIG. 4 shows the sequence of signal blocks generated by the processor in the hand held dictation device.

The compressed information is included in blocks of information (or 'files') . . . $B_i$, $B_{i+1}$, $B_{i+2}$ . . . . This is shown in FIG. 4. Each block of information $B_i$ has a header portion, denoted HDR, and an information portion, denoted IP. Further, an identifier signal is stored in the header portion. The identifier signal in a header portion HDR of a signal block identifies the compression mode applied on the speech signal in order to generate the data compressed information stored in the information portion IP of that same signal block. The sequence of signal blocks is supplied to the digital output 32 of the processor 30 and subsequently stored in the memory 20 on the memory card 15.

It should be noted here, that the processor 30 could generate signal blocks as long as required to store the information of exactly one speech message in. The processor 30 may also be adapted to generate signal blocks of fixed length, and that the data compressed information of a speech message is stored in a plurality of subsequent signal blocks generated by the processor 30.

Figure 5:
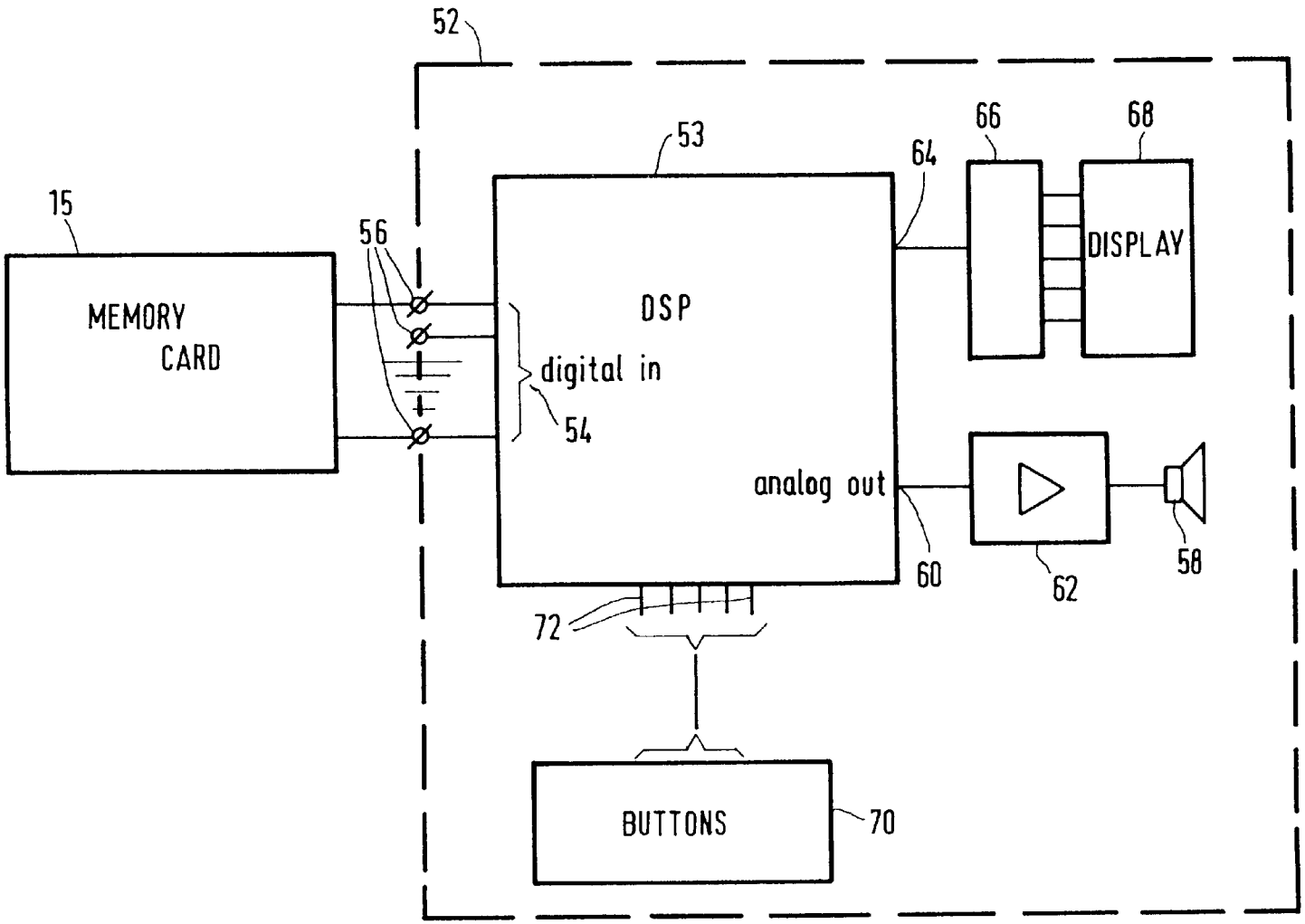
FIG. 5 shows an embodiment of a transcription apparatus, either in table top, or in PC form.

If the user wants to listen to the speech message stored in the memory 20, the processor 30 is capable of retrieving the data compressed information from the memory 20 and carry out a data expansion step on the data compressed information stored in the memory. It will be clear that the data expansion step will be the inverse of the data compression step carried out during dictation. The data expansion step to be carried out in the processor 30 will be further explained hereafter, with respect to an embodiment of a transcription apparatus, as shown in FIG. 5. After having obtained a replica of the speech signal, this speech signal is D/A converted in the processor and supplied to the output 40, for reproduction by the loudspeaker 18.

For transcription of the speech messages stored in the memory 20 on the memory card 15, the memory card 15 is withdrawn from the device 1 and inserted in a table top transcription apparatus 50, see FIG. 5. The transcription apparatus 52 comprises a digital signal processor 53, having a digital input 54 coupled to terminals 56 that are electrically coupled to the terminals 22 of the memory card 15, when positioned in a slot (not shown) provided in the apparatus 52. A loudspeaker 58 is coupled to an analog output 60 of the processor 53, via an amplifier 62. The processor 53 further comprises a control output 64 which is coupled to a display control unit 66 for controlling the display of information on a display 68. A keyboard 70 is coupled to control inputs 72 of the processor 53.

The user places the memory card 15 into the slot (not shown) of the transcription apparatus 52 until the terminals 22 of the memory card 15 come into contact with electrical terminals 56 provided in the slot of the transcription apparatus 52. The memory card is now in electrical and mechanical contact with the apparatus 52.

Upon actuating a 'RETRIEVE' button on the keyboard 70, the information stored in the memory 20 on the memory card 15 is read out and stored in an internal memory of the digital signal processor 53. The processor 53 is capable of carrying out one of at least two different data expansion steps on the digital information retrieved from the memory card. It will be clear that the expansion mode carried out in the processor 53 is the inverse of the compression mode carried out during the dictation step in the processor 30. The processor 53 retrieves the respective identifier signal from the header portion HDR of the signal block and carries out a data expansion step in response to the identifier signal. As a result, a replica of the digital speech signal is obtained.

The processor 53 is further capable of D/A converting the replica of the digital speech signal into an analog speech signal and to supply the analog speech signal via the output 60 to the loudspeaker 58, so that a typist or other person can hear the speech signal that is to be transcribed.

The typist can type in the speech message reproduced via the loudspeaker using the keyboard 70, so as to obtain a typed version of the speech message.

In another embodiment of the transcription apparatus 52, when realized in the form of a personal computer, having a sufficiently large memory capacity, the apparatus may be provided with a speech recognition algorithm which enables the apparatus to generate a character file from the speech signal as a result of such speech recognition step. The character file could be made visible on the display 68, so that the typist can check for errors by reading the text on the display screen 68 and hearing the speech message via the loudspeaker 58, and correct those errors using the keyboard 70.

Previously an example of a lossless data compression method has been described, namely: linear predictive coding followed by a Huffman encoding. It will speak for itself that the processor 53 must be capable of carrying out a corresponding Huffman decoding followed by a corresponding linear predictive decoding in order to regenerate the original speech signal.

An example of a lossy data compression step has also been described, namely: subband coding. It will speak for itself that the processor 53 must be capable of carrying out a corresponding subband decoding in order to regenerate a replica of the original speech signal.

While the present invention has been described with respect to preferred embodiments thereof, it is to be understood that these are not limitative examples. Thus, various modifications may become apparent to those skilled in the art, without departing from the scope of the invention, as defined by the claims. Further, the invention lies in each and every novel feature or combination of features as herein disclosed.

Related documents (1) European Patent Application no. 402,973 (PHN 13.241).

(2) European Patent Application no. 400.755 (PHQ 89.018A).

(3a) European Patent Application no. 457,390 (PHN 13.328).

(3b) European Patent Application no. 457,391 (PHN 13.329).

What is claimed is:

1. A dictation system comprising a hand-held dictation device for storing a speech signal in memory means, the dictation device comprising:

user selection means for selecting one of at least two different data compression modes, said modes resulting in different data compression ratios when applied to the same speech signal, means for generating an identifier signal identifying the selected mode, means for storing said identifier signal in a header portion of a data file, means for compressing at least a portion of the speech signal according to said selected mode, means for storing compressed speech signals, compressed according to said selected mode only, in said data file, and storing means for storing said data file in the memory means.

2. A dictation system as claimed in claim 1, wherein the memory means comprise a removable solid state memory unit for storing the data files, the solid state memory unit having coupling means for mechanically and electrically coupling the memory unit to the hand-held dictation device.

3. A dictation system as claimed in claim 2, wherein the coupling means are arranged to alternatively couple the memory unit mechanically and electrically to a personal computer (PC).

4. A dictation system as claimed in claim 3, wherein the coupling means mechanically and electrically couple the memory unit to an internationally-standardized interface of the PC.

5. A dictation system as claimed in claim 4, wherein said interface is a PCMCIA interface.

6. A dictation system as claimed in claim 2, wherein the solid state memory unit comprises an EEPROM.

7. A dictation system as claimed in claim 2, wherein the solid state memory unit comprises a flash-erasable memory unit.

8. A dictation system as claimed in claim 2, wherein the solid state memory unit comprises a back-up battery.

9. A dictation system as claimed in claim 2, wherein at least one of the two different data compression modes is a lossy data compression mode.

10. A dictation system as claimed in claim 1, wherein the user selection means comprises a recording mode switch.

11. A hand-held dictation device comprising:

user selection means for selecting one of at least two different data compression modes, said modes resulting in different data compression ratios when applied to the same speech signal, means for generating an identifier signal identifying the selected mode, means for storing said identifier signal in a header portion of a data file, means for compressing at least a portion of the speech signal according to said selected mode, means for storing compressed speech signals, compressed according to said selected mode only, in said data file, and storing means for storing said data file in a memory means.

12. A hand-held dictation device as claimed in claim 15, wherein the coupling means conform to an internationalely-standardized interface.

13. A hand-held dictation device as claimed in claim 12, wherein said interface is a PCMCIA interface.

14. A hand-held dictation device as claimed in claim 11, wherein the user selection means comprises a recording mode switch.

15. A hand-held dictation device as claimed in claim 11, wherein said memory means comprises a removable solid state memory unit, further comprising coupling means for mechanically and electrically cooperating with coupling means of said removable solid state memory unit.

16. A hand-held dictation device as claimed in claim 11, wherein at least one of the two different data compression modes is a lossy data compression mode.

17. A transcription device for transcribing speech messages, comprising:

data expansion means for expanding a data-compressed speech signal stored in memory means, where the data-compressed speech signal is (i) compressed in a selected one of at least two different data compression modes, the at least two different data compression modes resulting in different data compression ratios when applied to the same speech signal, and (ii) stored in the memory means in at least one data file comprised of at least a portion of the data-compressed speech signal, each data file including a respective header portion in which an identifier signal is stored, the identifier signal identifying the data compression mode selected to perform data compression on the speech signal;

wherein the data expansion means comprising means for alternatively performing one of at least two different types of data expansion corresponding respectively to the at least two different data compression modes, and the data expansion means expands the data-compressed signal by (i) retrieving the identifier signal from the header portion of the respective data file, and (ii) responsive to the retrieved identifier signal, performing on the data-compressed speech signal the one of said different types of data expansion corresponding to the data compression mode identified by the identifier signal, so as to obtain a replica of the speech signal.

18. A transcription device as claimed in claim 17, wherein the memory means is a removable solid state memory unit, and wherein the transcription device further comprises coupling means for mechanically and electrically cooperating with coupling means of said removable solid state memory unit.

19. A transcription device as claimed in claim 18, wherein the coupling means conform to an internationally-standardized interface.

20. A transcription device as claimed in claim 19, wherein said interface is a PCMCIA interface.

21. A removable solid state memory unit which stores a data-compressed speech signal, wherein the data-compressed speech signal is:

(i) compressed in one of at least two different data compression modes, the at least two different data compression modes resulting in different data compression ratios when applied to the same speech signal, and (ii) stored in the memory unit in at least one data file comprised of at least a portion of the data-compressed speech signal, each data file including a respective header portion in which an identifier signal is stored, the identifier signal identifying the data compression mode used to produce the data-compressed speech signal.

22. A solid state memory unit as claimed in claim 21, further comprising coupling means for mechanically and electrically coupling the memory unit to a personal computer (PC).

23. A solid state memory unit as claimed in claim 22, wherein the coupling means conform to an internationally-standardized interface.

24. A solid state memory unit as claimed in claim 23, wherein said interface is a PCMCIA interface.

* * * * *